US005688186A

United States Patent [19]

Michaels et al.

[11] Patent Number: 5,688,186

[45] Date of Patent: Nov. 18, 1997

[54] GOLF CLUB FACE

[76] Inventors: Richard A. Michaels, 1845 Twin Oaks Dr., Girard, Ohio 44420; John VonSchwartz, 12951 Gladstone Rd., N. Jackson, Ohio 44451

[21] Appl. No.: 626,680

[22] Filed: Apr. 2, 1996

[51] Int. Cl.[6] ..... A63B 53/04

[52] U.S. Cl. ..... 473/290; 473/331; 473/324

[58] Field of Search ..... 473/324, 330, 473/331, 287, 290, 291, 350, 342; D21/219, 220, 221

[56] References Cited

U.S. PATENT DOCUMENTS

| | | | |
|---|---|---|---|
| D. 101,108 | 9/1936 | Ellingham | D21/220 |
| D. 104,495 | 5/1937 | Gallagher | D21/220 |
| D. 192,366 | 3/1962 | Penna | D21/220 |
| D. 222,679 | 11/1971 | Gryseels | D21/220 |
| D. 241,359 | 9/1976 | Taylor | D21/220 |
| D. 285,818 | 9/1986 | Moore | D21/219 |
| D. 336,758 | 6/1993 | Jossey | D21/220 |
| 2,005,401 | 6/1935 | Storz | 473/331 |
| 2,520,950 | 9/1950 | Miller . | |
| 2,926,913 | 3/1960 | Stecher . | |
| 3,468,544 | 9/1969 | Antonious | 473/327 |
| 4,508,349 | 4/1985 | Gebauer et al. . | |
| 4,529,203 | 7/1985 | Ribaudo . | |
| 4,754,975 | 7/1988 | Aizawa . | |
| 4,792,140 | 12/1988 | Yamaguchi | 473/331 |
| 4,917,384 | 4/1990 | Caiati . | |
| 5,029,865 | 7/1991 | Kim | 473/330 |
| 5,090,702 | 2/1992 | Viste | 473/345 |
| 5,190,289 | 3/1993 | Nagai | 473/327 |
| 5,354,059 | 10/1994 | Stuff . | |
| 5,358,249 | 10/1994 | Mendralla . | |
| 5,380,004 | 1/1995 | Teramoto et al. . | |

FOREIGN PATENT DOCUMENTS

| | | | |
|---|---|---|---|
| 2179262 | 3/1987 | United Kingdom | 273/77 A |

OTHER PUBLICATIONS

Golf Digest, Feb. 1988, p. 51.

*Primary Examiner*—Sebastiano Passaniti
*Attorney, Agent, or Firm*—Nixon & Vanderhye P.C.

[57] ABSTRACT

A new golf club face design is disclosed in which different regions of grooves are provided in the vertical direction of the club face to impose different roll/bite characteristics on a golf ball depending on where the golf ball contacts the club face. In one embodiment, the golf club face has three characteristic regions of different types of grooves in the vertical direction of the club face. Different irons within the golf club set can also have different characteristic grooves in the three defined regions of the club face.

66 Claims, 4 Drawing Sheets

GOLF CLUB FACE

FIELD OF THE INVENTION

This invention relates to golf clubs, and in particular, to specialized golf club faces.

BACKGROUND OF THE INVENTION

Golf clubs can be classified into two groups: irons and woods. Each of the "woods" is typically characterized by a large, bulbous head (for striking the ball) attached to a long shaft (for swinging the head). The irons are typically shorter length clubs and range in sizes numerically from a "one" iron through a "nine" iron and the "wedges." The irons typically have a lofted, generally flat, metal head attached to a shaft. The low numbered irons have less-lofted heads and longer shafts, thus allowing them to send the ball relatively farther and lower on impact, while the high number irons and "wedges" have greatly lofted heads and shorter shafts, thus allowing them to send the ball relatively shorter and higher on impact.

The "bite" of the iron is an important characteristic of the clubs. "Bite" is a term used to characterize the amount of backward spin that a ball has after it leaves the striking club face. A ball with a lot of "bite" will have a lot of backward spin, thus causing it to stop quickly on landing, without a lot of forward "roll." A ball with bite thus has high spin and low roll. The bite is determined by the shape of the grooves on the club (square shaped grooves are regarded as giving more bite than rounded grooves) and by the contact of the club face on the ball. A swing in which the ball strikes too high on the club face during the swing is called hitting "fat" (giving more bite) and a swing in which the ball strikes too low on the club face during the swing is called hitting "thin" (giving less bite).

Typically, the short-range irons, as a result of their shaft and loft characteristics, give more bite and less distance when hit properly then do long-range irons. Unfortunately, when irons are mis-hit fat, they do not send the ball as far as desired. When short-range irons are mis-hit thin, the ball goes too far. When long-range irons are mis-hit thin, the ball gets too much bite and too little distance. This has caused club designers to alter such things as the weighting of the club head and the stiffness of the shaft in an effort to make the irons more forgiving of mishits and thus more amenable to recreational play.

SUMMARY OF THE INVENTION

The present golf club faces result from a recognition that three desirable objectives should be obtained in order to improve the forgiveness of a golf club, especially when it is "mis-hit":

1. Shots hit "fat" should be adjusted to decrease the spin (and increase the roll);
2. Shots hit "thin" with lofted irons should be adjusted to increase spin; and
3. Shots hit "thin" with longer irons should be adjusted to decrease spin.

These objectives can be achieved by varying the grooves on the club face to include two, three or more regions of grooves on each club face. The grooves in these regions are chosen depending upon the loft of the club in order to improve the distance and spin conditions that occur when the club is hit, respectively, thin or fat.

Four example sets of club faces provide the desired characteristics. The so-called V-Square Design provides a region of V-shaped grooves and a region of squarer-shaped grooves on the same club face. The so-called Square-Square Design provides different regions of square-shaped grooves having different depths on the same club face. The so-called Dimple-Square Design provides a region of dimples and a region of squarer-shaped grooves on the same club face. And, the Flat-Square Design provides a sand-blasted region and a region of squarer-shaped grooves on the same club face.

The purpose and advantages gained by the present invention will be understood by careful study of the following detailed description of the presently preferred embodiment with particular reference to the accompanying drawings.

DETAILED DESCRIPTION OF THE PRESENTLY PREFERRED EMBODIMENT

The present invention provides improved golf club heads in which different regions of each golf club head includes different types of grooves designed particularly for short-, mid-, and long-range irons. The applicant uses the term "groove" in this description and in the attached claims to mean cuts, crevices, punches, etc. that are cut into a club face, as well as dimples and ridges that extend from the club face. In the preferred embodiment, the grooves will be parallel crevices arranged generally horizontally (relative to the ground) on the club face. According to the present invention, different types of grooves are provided on each club face so that the club face would be more forgiving of mis-hits.

According to the presently preferred embodiment, the club face design includes three separate regions with a progressive pattern of grooves in the respective regions. The design includes a separate club face design for each of the short-, mid-, and long-range irons due to the different results desired from mis-hits, depending on the distance that the ball was from the green and the club selected. The present invention is a club face design and may be used with any type of known shafts or club heads. In particular, the present invention may be employed in both tour blades (i.e., non-cavity back club heads) and cavity-back clubs, as well as any other club head designs developed. The present invention may also be employed in both mid-sized and over-sized clubs. It may also be employed in club faces per se or in club face inserts.

Example embodiments of the present golf club sets are shown and described below with respective to FIGS. 1–3, 4–6, 7–9, and 10–12, respectively. Although in each of these Figures, the club heads are shown with three regions of different types of grooves, the present invention is not limited to any of the particular embodiments shown, the particular types of grooves shown, the number of grooves shown nor the number of regions shown (provided at least two regions of different types of grooves are provided on each club).

Figure 1:
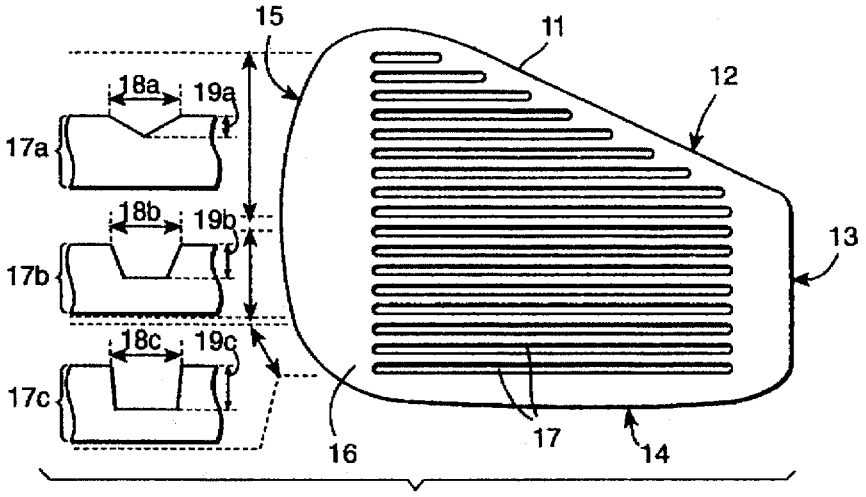
FIGS. 1–3 are side elevation views of the short-, mid- and long-irons according to the example "V-Square" embodiment of the present invention.
Figure 2:
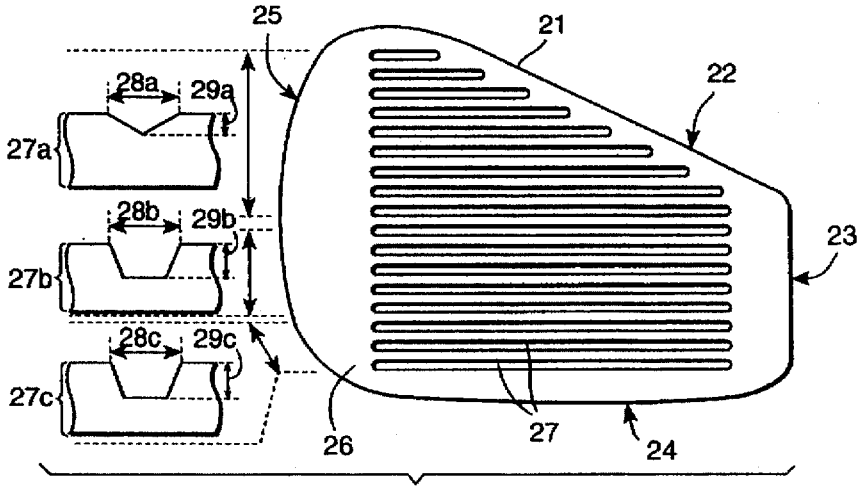
Figure 3:
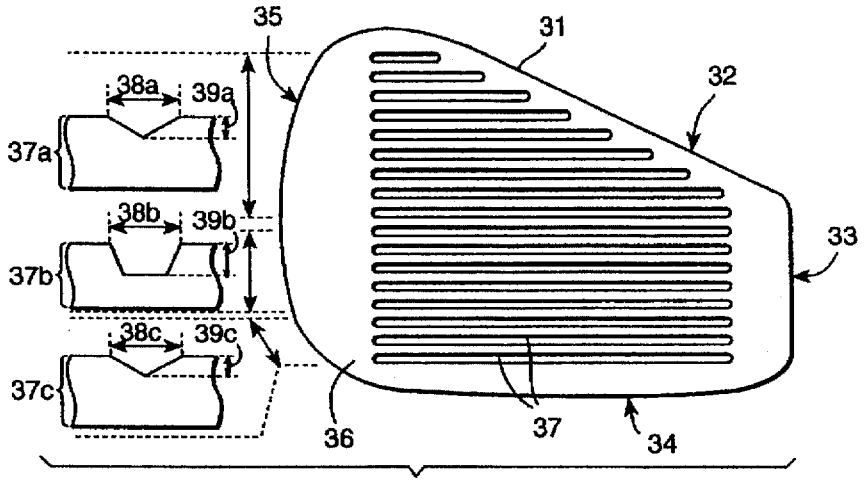

FIGS. 1–3 illustrate the example embodiment of the so-called "V-Square" design golf club set. FIG. 1 illustrates the design of the club face for the 7 iron through sandwedge (the short-rangeirons), FIG. 2 illustrates the design for the 4 iron through the 6 iron (the mid-range irons), and FIG. 3 illustrates the design for the 1 iron through the 3 iron (the long-range irons). In combination, the clubs of FIGS. 1–3 comprise a set of golf club irons.

Note that in each of the FIGS. (1–12), the identification numbers for corresponding parts of each club face have corresponding suffixes (for example, elements 11, 12, 13 . . . in FIG. 1 correspond to elements 21, 22, 23 . . . in FIG. 2, elements 31, 32, 33 . . . in FIG. 3 and elements 41, 42, 43 . . . in FIG. 4, and so on) so that descriptions with respect to one Figure are generally applicable to corresponding sections in the remaining Figures.

As shown in FIG. 1, the short irons in the example "V-Square" design have a club head 11 having a top edge 12, a heel 13, a bottom edge 14, and a toe 15. The top edge is the edge that points generally skyward when the player addresses the golf ball. The bottom edge, in turn, generally rests on the ground when the player addresses the golf ball. The shape and sizes of the respective edges, heel and toe are not critical to the present invention and may be modified or adjusted and still be within the scope of the present invention. Each club head 11 has a club face 16 having grooves 17 etched, cut or placed thereon.

As shown in FIG. 1, the grooves for the short irons according to the "V-Square" design are divided into three regions of the club face 16. The grooves in the upper groove region 17A are shallow V-shaped crevices. These crevices allow a fat shot hit with the short irons to roll and gain more distance for the golfer. The grooves in the middle groove region 17B are a normal USGA square groove pattern since no adjustment is desired for a well hit ball contacting the middle portion of the lofted club face 16. The bottom groove region 17C consists of deep square crevices, to maximum depths allowed by USGA standards. These deep square crevices improve the back spin on the ball for thin shots. In this specification and in the appended claims, the term "square" or "square-shaped" shall include square sided grooves of any dimension or configuration from normal USGA square grooves (as shown for example in region 17B) through deep square grooves (as shown for example in region 17C). Within the general term of "square" grooves, the term "deep square" refers to grooves with generally straight sides relative to the bottom, as shown in region 17C, and "normal square" refers to grooves with angled sides relative to the bottom, as shown in region 17B.

In the example embodiment shown in FIG. 1, the bottom groove region 17C consists of the lower three grooves on the club face. The middle groove region 17B consists of the next four grooves on the club face. The upper groove region 17A consists of the remaining grooves to the top edge 12 of the club face 16. This arrangement is the presently preferred embodiment, but the invention is not limited to this particular number or distribution of grooves.

The grooves in the upper groove region 17A are also shown in cross-section in FIG. 1. The width 18A of the grooves in the upper region 17A is 0.035 inches and the depth 19A is 0.010 inches. The grooves in the mid-region 17B have a width 18B of 0.035 inches and a depth 19B of 0.017 inches. In the lower groove region 17C, the grooves have a width 18C of 0.035 inches and a depth 19C of 0.020 inches.

FIG. 2 shows the design for the mid-range irons, such as the 4 iron to the 6 iron, in the V-Square design. Here, the club head 21 again includes top edge 22, heel 23, bottom edge 24, toe 25, club face 26, and grooves 27, corresponding to like-suffixed numbers in FIG. 1. Like the design in FIG. 1 for the short-range irons, the mid-range irons in FIG. 2 include three regions of grooves, 27A, 27B, and 27C. The grooves in the upper region 27A are shallow V-shaped grooves for the same reasons described above with respect to the top groove region 17A in FIG. 1. These grooves have a width 28A of 0.035 inches and a depth 29A of 0.01 inches. The grooves in the mid-region 27B are also identical to the mid-region grooves 17B in FIG. 1 for the same reasons. These grooves have a width 28B of 0.035 inches and a depth 29B of 0.017 inches. The grooves in the lower groove region 27C in the mid-range irons of FIG. 2 are normal square grooves to provide slightly more roll on thin shot mis-hits than will the short-range irons of FIG. 1. The width 28C of the grooves in the bottom region 27C is 0.035 inches and the depth 29C is 0.020 inches (i.e., slightly deeper than the square grooves in the mid-range 27B).

Finally, FIG. 3 illustrates the long-range irons in the V-Square design. Like the short-range irons in FIG. 1 and the mid-range irons in FIG. 2, the long-range irons in FIG. 3 include three regions of grooves 37A, 37B, and 37C on each club face 36. For the long-range irons, the upper groove region 37A has V-shaped grooves with a width 38A of 0.035 inches and a depth 39A of 0.01 inches. This, again, allows a fat shot with the long irons to roll and gain more distance for the golfer. The grooves in the mid-region 37B are normal square grooves with a width 38B of 0.035 inches and a depth 39B of 0.017 inches. The grooves in the lower groove region 37C for the long-range irons of FIG. 3 are also V-shaped grooves to provide more roll for thin shots. This provides more distance for the long irons, even for thin shots, which is the desired result when using the long-range clubs. The grooves in the lower groove region 37C have a width 38C of 0.035 inches and a depth 39C of 0.01 inches.

Although the applicant has provided specific dimensions for the various grooves in the various clubs, these dimensions were only for illustration. The present invention is not limited to any particular dimensions of the grooves, provided the different groove regions provide grooves of different cross-sectional configurations to adjust the trajectory of balls hit thin and fat. In addition, the grouping of clubs into the short-range, mid-range, and long-range irons may be different than as described above and still be within the scope of the present invention. For example, the 7 iron, which is grouped in the short-range irons of FIG. 1, may in some instances be more appropriately grouped with the mid-range irons of FIG. 2. Similarly, the 4 iron may be grouped with the mid-range irons, as described, or may in some instances be more appropriately grouped with the long-range irons. Other changes in the groupings are also within the design preferences of the ordinarily skilled artisan.

Figure 4:
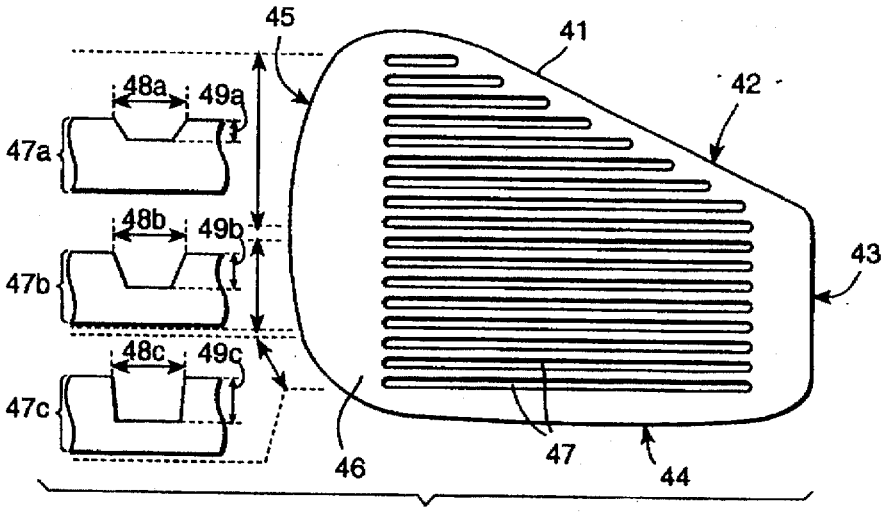
FIGS. 4–6 are side elevation views of the club faces for the short-, mid-, and long-irons according to the example "Square-Square" embodiment of the present invention.
Figure 5:
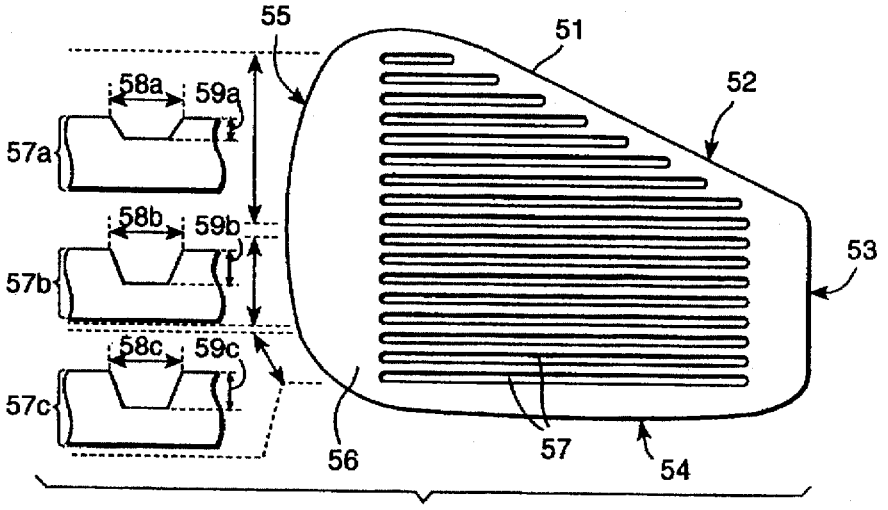
Figure 6:
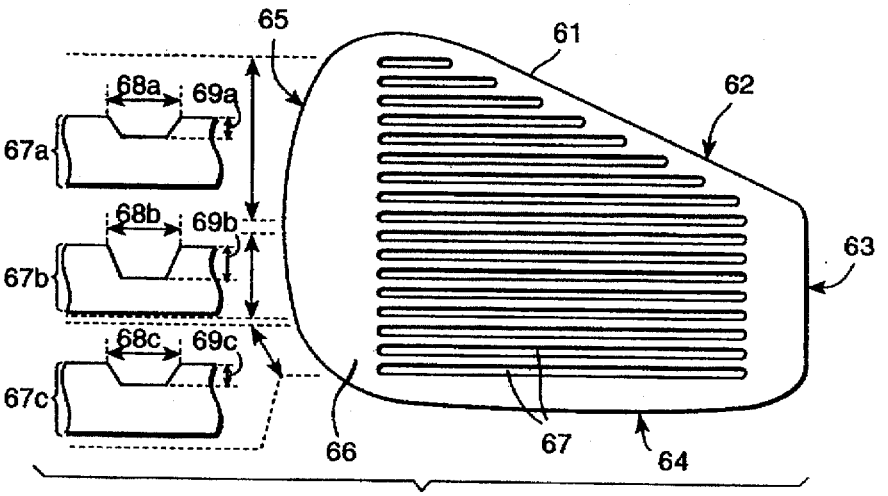

FIGS. 4–6 illustrate another embodiment of the present invention, the so-called Square-Square design. In FIGS. 4–6, club heads (41, 51, 61) include top edges (42, 52, 62), heels (43, 53, 63), bottom edges (44, 54, 64), toes (45, 55, 65), faces (46, 56, 66), and grooves (47, 57, 67). FIG. 4 shows the club face for the short-range irons (for example, the 7 iron through the sandwedge). FIG. 5 shows the club face design for the mid-range irons (for example, the 4 iron through the 6 iron). FIG. 6 shows the club face design for the long-range irons (for example, the 1 iron through the 3 iron). Each of the club faces includes 3 regions of grooves (47A–C, 57A–C, 67A–C). The shapes of the grooves are as shown in FIGS. 4–6 and their dimensions are as follows:

| GROOVES | DIMENSIONS |
|---|---|
| 48A | .035 inches |
| 48B | .035 inches |
| 48C | .035 inches |
| 49A | .01 inches |
| 49B | .017 inches |
| 49C | .020 inches |
| 58A | .035 inches |
| 58B | .035 inches |
| 58C | .035 inches |
| 59A | .01 inches |
| 59B | .017 inches |
| 59C | .02 inches |
| 68A | .035 inches |
| 68B | .035 inches |
| 68C | .035 inches |
| 69A | .01 inches |
| 69B | .017 inches |
| 69C | .01 inches |

In FIG. 4, the short-range irons have on upper region 47A of shallow square grooves, a middle region 47B of normal square grooves, and a lower region 47C of deep square grooves. The mid-range irons (FIG. 5) have an upper region of shallow square grooves, a middle region of normal square grooves and a lower region of normal square grooves (slightly deeper than the normal square grooves in the middle region). Finally, the long range irons (FIG. 6) have shallow square grooves in an upper region, normal square grooves in a mid-region, and shallow square grooves in a lower region.

Figure 7:
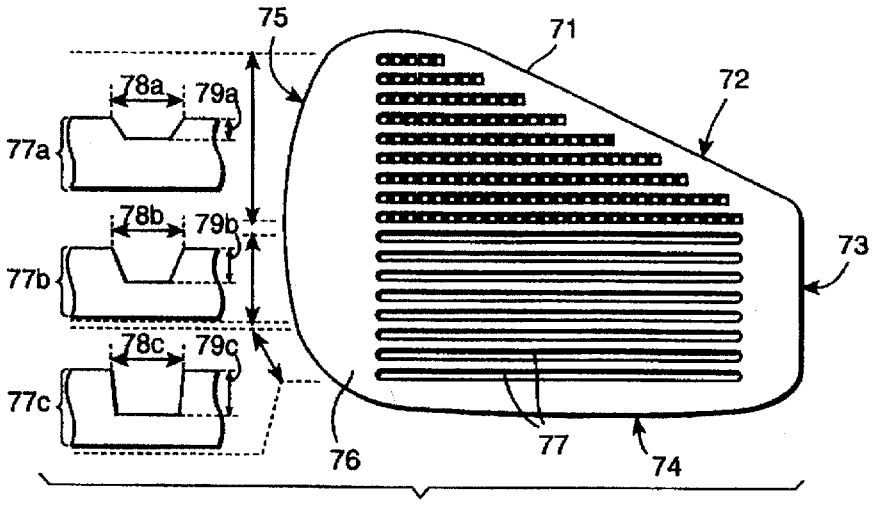
FIGS. 7–9 are side elevation views of the club heads for the short-, mid-, and long-irons according to the example "Dimple-Square" embodiment of the present invention.
Figure 8:
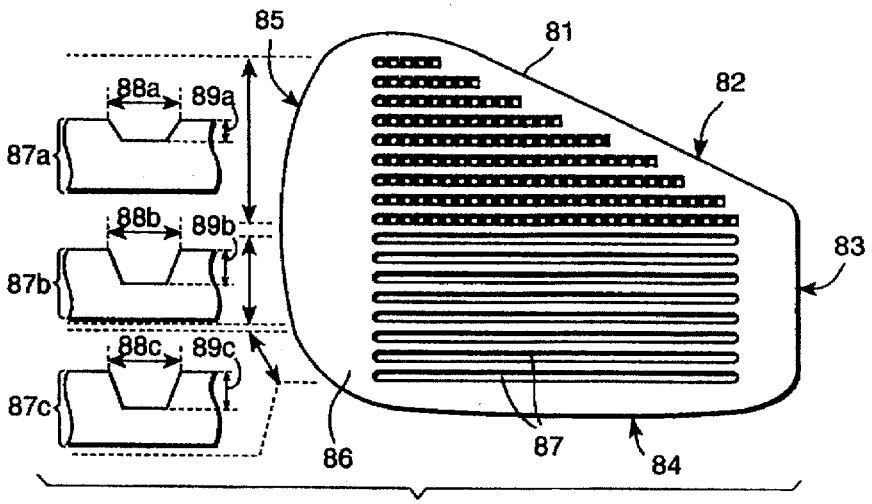
Figure 9:
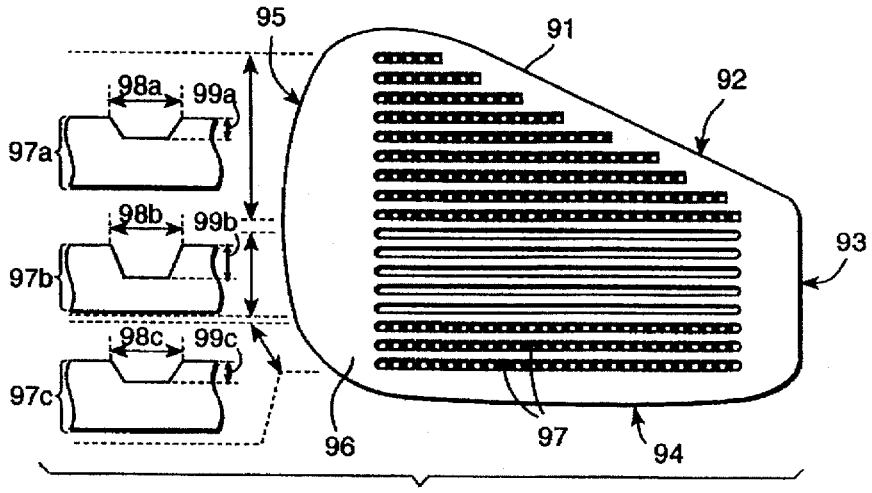

FIGS. 7–9 illustrate the "Dimple-Square" example embodiment golf club set according to the present invention. In this embodiment, the club heads (71, 81, 91), top edges (72, 82, 92), heels (73, 83, 93), bottom edges (74, 84, 94), toes (75, 85, 95), and club faces (76, 86, 96) are as described with respect to the earlier embodiments. In the dimple-square design, the grooves (77, 87, 97) take the form of crevices in the lower regions (77C and 87C) and the mid-regions (77B, 87B, and 97B) but take the form of dimples in the upper regions (77A, 87A, and 97A) and in the lower region (97C). In the dimple-square design, the dimples take the place of the shallow V-shaped grooves in the previous embodiments. They also accomplish the same functions of allowing a fat shot to roll and gain more distance. As in the previous embodiments, the short-range irons are shown in FIG. 7, the mid-range irons are shown in FIG. 8, and the long-range irons are shown in FIG. 9. For the long-range irons of FIG. 9, the dimples are located in both the upper groove region 97A and the lower groove region 97C. The exemplary dimensions for the grooves shown in FIGs. 7 through 9 are as follows:

| GROOVES | DIMENSIONS |
|---|---|
| 78A | .035 inches |
| 78B | .035 inches |
| 78C | .035 inches |
| 79A | .01 inches |
| 79B | .017 inches |
| 79C | .020 inches |
| 88A | .035 inches |
| 88B | .035 inches |
| 88C | .035 inches |
| 89A | .01 inches |
| 89B | .017 inches |

-continued

| GROOVES | DIMENSIONS |
|---|---|
| 89C | .02 inches |
| 98A | .035 inches |
| 98B | .035 inches |
| 98C | .035 inches |
| 99A | .01 inches |
| 99B | .017 inches |
| 99C | .01 inches |

The dimensions of these grooves can vary from the example dimensions above and still be within the scope of the invention, provided different groove regions are included.

Figure 10:
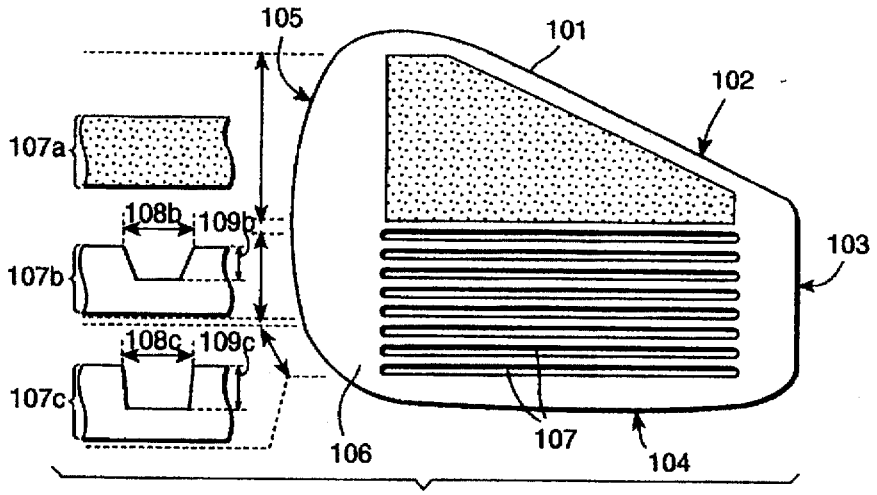
FIGS. 10–12 are side elevation views of the club heads for the short-, mid-, and long-irons according to the example "Flat-Square" embodiment of the present invention.
Figure 11:
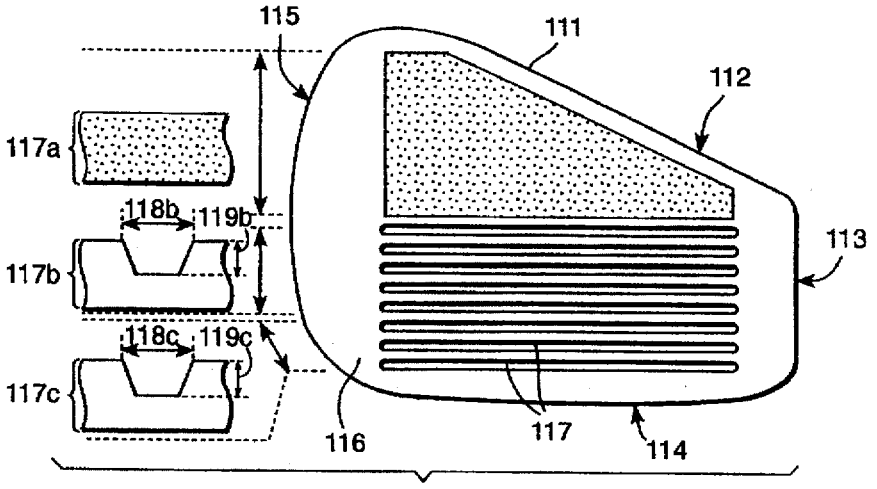
Figure 12:
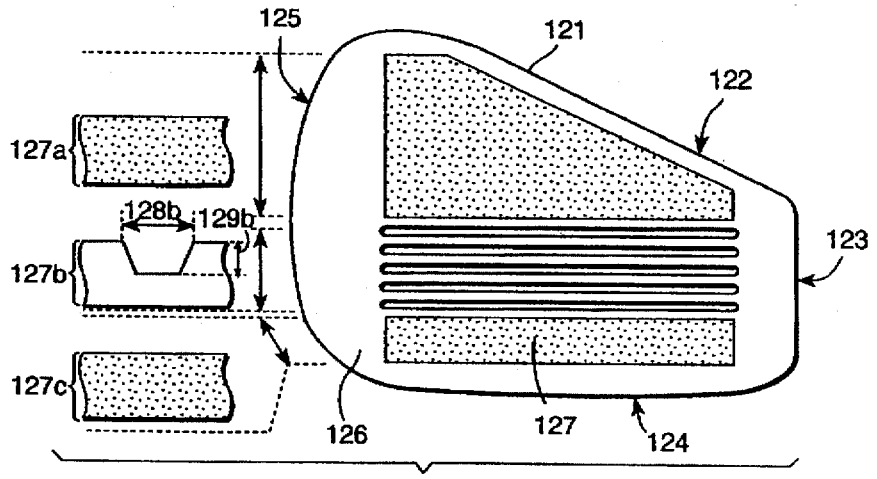

FIGS. 10–12 illustrate yet another embodiment of the present invention, the "Flat-Square" design of a golf club set. FIG. 10 illustrates the short-range irons, FIG. 11 illustrates the mid-range irons and FIG. 12 illustrates the long-range irons. In this design, a roughened, or sandblasted, surface takes the place of the shallow grooves (FIGS. 1–6) or the dimples (FIGS. 7–9). The club head (101, 111, 121), the upper edge (102, 112, 122), heel (103, 113, 123), bottom edge (104, 114, 124), toe (105, 115, 125), and club face (106, 116, 126) are as described in the previous embodiments. The grooves (107, 117, 127) take the form of normal square grooves in the mid-regions (107B, 117B, 127B). The grooves in the lower groove regions (107C and 117C) of the short- and mid-range irons (FIGS. 10 and 11) have deep square and normal square grooves, respectively. The lower region 127C of the long-range irons (FIG. 12) is a roughened or sandblasted surface of the club face. In addition, all of the upper region grooves (107A, 117A, 127A) are sandblasted or roughened surface of the club face, giving balls that are hit fat with any of the irons in the flat-square design less bite and more roll.

The exemplary dimensions for the grooves shown in FIGS. 10 through 12 are as follows:

| GROOVES | DIMENSIONS |
|---|---|
| 108B | .035 inches |
| 108C | .035 inches |
| 109B | .017 inches |
| 109C | .020 inches |
| 118B | .035 inches |
| 118C | .035 inches |
| 119B | .017 inches |
| 119C | .020 inches |
| 128B | .035 inches |
| 129B | .017 inches |

The above description provides just four examples of embodiments that are envisioned within the scope of the present invention. Other groove designs, groove dimensions, and groove types may be substituted for the various embodiments described above and shown in the accompanying Figures without departing from the present invention, provided different regions of grooves are provided in the vertical direction of a particular club face. In addition, while the above embodiments have well defined regions (such as regions 17A, 17B and 17C, for example), the changes in groove design, dimension, or shape may be gradual in the vertical direction of the club face, rather than in discrete units of regions as shown.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A golf club head, comprising:

a club face having upper, lower and middle regions of grooves, the regions oriented relative to each other in a generally vertical direction of the club head, each of the three regions having grooves with different cross-sectional configurations.

2. A golf club head according to claim 1, wherein:

the grooves are crevices cut shallower in the upper groove region than in the middle groove region, and still further shallower than in the lower groove region.

3. A golf club head according to claim 1, wherein:

the cross-sectional configuration of the grooves in the middle groove region is squarer than the grooves in the upper groove region, and the cross sectional configuration of the grooves in the lower groove region is squarer than the grooves in the middle groove region.

4. A golf club head according to claim 1, wherein:

the grooves in the upper, lower and middle regions are crevices and are mutually parallel.

5. A golf club head according to claim 1, wherein:

the grooves in at least the upper region are formed by dimples.

6. A golf club head according to claim 1, wherein:

the grooves respectively in the upper and lower regions have the same cross-sectional configurations.

7. A golf club head, comprising:

a club face having upper, lower and middle regions oriented in a generally vertical direction of the club face, the upper region comprising a roughened surface, the middle region comprising square-v grooves, and the lower region comprising square grooves.

8. A golf club head according to claim 7, wherein:

the lower region comprises square grooves cut deeper than the square-v grooves of the middle region.

9. A golf club head according to claim 7, wherein:

the lower region comprises a roughened surface.

10. A golf club head having a top edge and a bottom edge, comprising:

a club face having upper, lower and middle regions of grooves comprising generally parallel crevices, the grooves of the upper region being oriented nearer the top edge than the grooves of the middle region, and the grooves of the lower region being oriented nearer the bottom edge than the grooves of the middle region, and wherein the grooves of the upper region have a v-shaped cross-sectional configuration, and the grooves of the middle region have a square-v shaped cross-sectional configuration.

11. A golf club head according to claim 10, wherein:

the grooves of the upper region are shallower in depth than the grooves of the middle and lower regions.

12. A golf club head according to claim 10, wherein:

the grooves of the lower region have a square-v shaped cross-sectional configuration.

13. A set of golf club irons, comprising:

short-range, mid-range and long-range irons, each iron having a club face, each club face having a top edge, a bottom edge, a first region of grooves, and a second region of grooves, the first region having grooves oriented nearer the top edge than the grooves of the second region wherein:

the grooves in the first region of the short-range irons have a cross-sectional configuration different than the grooves in the second region of the short-range irons, and the grooves in the first region of the mid-range irons have a depth different than the grooves in the second region of the mid-range irons.

14. A set of golf club irons according to claim 13, wherein the grooves in the first and second regions of the long-range irons have the same cross-sectional configuration.

15. A set of golf club irons according to claim 13, wherein the grooves in the first region of the short-range irons are shallow V-shaped crevices, the grooves in the second region of the short-range irons are square-shaped crevices, the grooves in the first region of the mid-range irons are shallow V-shaped crevices, the grooves in the second region of the mid-range irons are square-shaped crevices, and the grooves in the first region of the long-range irons are V-shaped crevices.

16. A set of golf club irons according to claim 15, wherein:

the grooves in the second region of the long-range irons are square-shaped crevices.

17. A set of golf club irons according to claim 15, wherein:

the grooves in the second region of the long-range irons are V-shaped crevices.

18. A set of golf club irons according to claim 13, wherein the grooves in the first region of the short-range irons are shallow square-shaped crevices, the grooves in the second region of the short-range irons are square-shaped crevices, the grooves in the first region of the mid-range irons are shallow square-shaped crevices, the grooves in the second region of the mid-range irons are square-shaped crevices, the grooves in the first region of the long-range irons are shallow square-shaped crevices, and the grooves in the second region of the long-range irons are square-shaped crevices.

19. A set of golf club irons according to claim 18, wherein:

the grooves in the second region of the long-range irons are shallow square-shaped crevices.

20. A set of golf club irons according to claim 13, wherein the grooves in the first region of the short-range irons are shallow square-shaped dimples, the grooves in the second region of the short-range irons are square-shaped crevices, the grooves in the first region of the mid-range irons are shallow square-shaped dimples, the grooves in the second region of the mid-range irons are square-shaped crevices, the grooves in the first region of the long-range irons are shallow square-shaped dimples, and the grooves in the second region of the long-range irons are square-shaped crevices.

21. A set of golf club irons according to claim 20, wherein:

the grooves in the second region of the long-range irons are shallow square-shaped grooves.

22. A set of golf club irons according to claim 13, wherein the grooves in the first region of the short-range irons comprise a toughened surface, the grooves in the second region of the short-range irons are square-shaped crevices, the grooves in the first region of the mid-range irons comprise a roughened surface, the grooves in the second region of the mid-range irons are square-shaped crevices, and the grooves in the first region of the long-range irons comprise a roughened surface.

23. A set of golf club irons according to claim 22, wherein the grooves in the second region of the long-range irons are square-shaped crevices.

24. A set of golf club irons according to claim 23, wherein:

the grooves in the second region of the long-range irons comprise a roughened surface.

25. A set of golf club irons according to claim, 24, wherein the upper grooves of the short-range irons comprise a roughened surface, the middle grooves of the short-range irons are normal square crevices, the lower grooves of the short-range irons are deep square crevices, the upper grooves of the mid-range irons comprise a roughened surface, the middle grooves of the mid-range irons are normal square crevices, the lower grooves of the mid-range irons are normal square crevices, the upper grooves of the long-range irons comprise a roughened surface, the middle grooves of the long-range irons are normal square crevices, and the lower grooves of the long-range irons comprise a roughened surface.

26. A set of golf club irons, comprising:

short-range, mid-range and long-range irons, each iron having a club face, each club face having a top edge, a bottom edge, an upper groove region, a middle groove region, and a lower groove region, the upper, lower, and middle groove regions having, respectively, upper, lower and middle grooves, the upper groove region having upper grooves oriented nearer the top edge than the lower and middle groove regions, the lower groove region having lower grooves oriented nearer the bottom edge than the upper and middle groove regions, the middle groove region having middle grooves oriented between the upper and lower groove regions, and:

the lower, middle and upper grooves have cross-sectional configurations that are not mutually identical.

27. A set of golf club irons according to claim 26, wherein the upper grooves and the lower grooves of the short-range irons are crevices having different groove depths, and the upper grooves and the lower grooves of the mid-range irons are crevices having different groove depths, and the upper grooves and the lower grooves of the long-range irons are crevices having substantially the same depths.

28. A set of golf club irons according to claim 26, wherein:

the upper grooves of the short-range irons are V-shaped crevices, the middle grooves of the short-range irons are normal square crevices, the lower grooves of the short-range irons are deep square crevices, the upper grooves of the mid-range irons are V-shaped crevices, the middle grooves of the mid-range irons are normal square crevices, the lower grooves of the mid-range irons are normal square crevices, the upper grooves of the long-range irons are V-shaped crevices, the middle grooves of the long-range irons are normal square crevices, and the lower grooves of the long-range irons are V-shaped crevices.

29. A set of golf club irons according to claim 26, wherein:

the normal square grooves in the middle groove region of the mid-range irons are shallower than the normal square grooves in the lower groove region of the mid-range irons.

30. A set of golf club irons according to claim 29, wherein:

the upper grooves of the short-range irons are shallow square crevices, the middle grooves of the short-range irons are normal square crevices, the lower grooves of the short-range irons are deep square crevices, the upper grooves of the mid-range irons are shallow square crevices, the middle grooves of the mid-range irons are normal square crevices, the lower grooves of the mid-range irons are square crevices, the upper grooves of the long-range irons are shallow square crevices, the middle grooves of the long-range irons are normal square crevices, and the lower grooves of the long-range irons are shallow square crevices.

31. A set of golf club irons according to claim 26, wherein, the normal square grooves in the middle groove region of the mid-range irons are shallower than the normal square grooves in the lower groove region of the mid-range irons.

32. A set of golf club irons according to claim 26, wherein:

the upper grooves of the short-range irons are shallow square dimples, the middle grooves of the short-range irons are normal square crevices, the lower grooves of the short-range irons are deep square crevices, the upper grooves of the mid-range irons are shallow square dimples, the middle grooves of the mid-range irons are normal square crevices, the lower grooves of the mid-range irons are normal square crevices, the upper grooves of the long-range irons are shallow square crevices, the middle grooves of the long-range irons are normal square crevices, and the lower grooves of the long-range irons are shallow square crevices.

33. A set of golf club irons according to claim 32, wherein the normal square grooves in the middle groove region of the mid-range irons are shallower than the normal square grooves in the lower groove region of the mid-range irons.

34. A set of golf club irons according to claim 33, wherein:

the normal square grooves in the middle groove region of the mid-range irons are shallower than the normal square grooves in the lower groove region of the mid-range irons.

35. A golf club comprising:

a club face, having at least three grooves, the three grooves comprising, in a vertical direction of the club face, an upper groove, a middle groove, and a lower groove, the upper groove being oriented highest in the vertical direction, and the lower groove being oriented lowest in the vertical direction, wherein at least two of the upper, middle and lower grooves have square-v cross-sectional configurations at different depths.

36. A golf club according to claim 35, wherein: the upper and middle grooves have square-v cross-sectional configurations, and the upper groove is deeper than the middle groove.

37. A golf club according to claim 36, wherein the upper groove is a roughened surface, and the middle groove and lower groove have identical square-v cross-sectional configurations.

38. A golf club according to claim 35, wherein the upper groove is V-shaped, and the middle and lower grooves are square-v shaped.

39. A golf club according to claim 35, wherein the middle and lower grooves have squarely cross-sectional configurations.

40. A golf club according to claim 35, wherein the upper groove is a set of dimples.

41. A golf club according to claim 35, wherein the upper groove is a roughened surface.

42. A golf club according to claim 35, wherein the upper groove is a set of dimples, and the lower groove is more square-shaped than the middle groove.

43. A golf club according to claim 35, wherein the upper groove is a roughened surface, and the lower groove is more square-shaped than the middle groove.

44. A golf club head having a top edge and a bottom edge, comprising:

a club face having upper, lower and middle regions of grooves comprising generally parallel crevices, the grooves of the upper region being oriented nearer the top edge than the grooves of the middle region and the grooves of the lower region being oriented nearer the bottom edge than the grooves of the middle region, and wherein the grooves of the upper region have a square-v shaped cross-sectional configuration at a first depth, and the grooves of the middle region have a square-v shaped cross-sectional configuration at a second depth deeper than the first depth.

45. A golf club head according to claim 44, wherein:

the grooves of the lower region have a square-v shaped cross-sectional configuration at the first depth.

46. A golf club head according to claim 44, wherein:

the grooves of the lower region have a square-v shaped cross-sectional configuration at the second depth.

47. A golf club head having a top edge and a bottom edge, comprising:

a club face having upper, lower and middle regions, the upper region being oriented nearer the top edge than the middle region and the lower region being oriented nearer the bottom edge than the middle region, and wherein:

the upper region has dimples of a square-v cross-sectional configuration at a first depth;

the middle region has parallel grooves having a square-v cross sectional configuration at a second depth deeper than the first depth; and the lower region has indentations.

48. The golf club head of claim 47, wherein:

the indentations of the lower region are grooves.

49. The golf club head of claim 48, wherein:

the grooves in the lower region have a square cross-sectional configuration.

50. The golf club head of claim 48 wherein:

the grooves in the lower region have a square-v cross-sectional configuration at the second depth.

51. The golf club head of claim 47, wherein:

the indentations of the lower region are dimples.

52. The golf club head of claim 51, wherein:

the dimples are punch marks.

53. The golf club head of claim 51, wherein:

the dimples have a square-v cross-sectional configuration at the first depth.

54. The golf club head of claim 47, wherein:

the dimples are punch marks.

55. A sand wedge having a club face with a top edge and a bottom edge, comprising:

upper, lower and middle regions on the club face, the upper region being oriented nearer the top edge than the middle region and the lower region being oriented nearer the bottom edge than the middle region, and wherein:

the upper region has dimples of a square-v cross-sectional configuration at a first depth;

the middle region has parallel grooves having a square-v cross-sectional configuration at a second depth deeper than the first depth; and the lower region has parallel grooves having a squarer cross-sectional configuration than the grooves of the middle region.

56. A sand wedge according to claim 55, wherein:

the dimples are punch marks.

57. A pitching wedge having a club face with a top edge and a bottom edge, comprising:

upper, lower and middle regions on the club face, the upper region being oriented nearer the top edge than the middle region and the lower region being oriented nearer the bottom edge than the middle region, and wherein:

the upper region has dimples of a square-v cross-sectional configuration at a first depth;

the middle region has parallel grooves having a square-v cross-sectional configuration at a second depth deeper than the first depth; and the lower region has parallel grooves having a squarer cross-sectional configuration than the grooves of the middle region.

58. The pitching wedge according to claim 57, wherein:

the dimples are punch marks.

59. A sand wedge having a club face with a top edge and a bottom edge, comprising:

upper, lower and middle regions on the club face, the upper region being oriented nearer the top edge than the middle region and the lower region being oriented nearer the bottom edge than the middle region, and wherein:

the upper region has a roughened surface;

the middle region has parallel grooves having a square-v cross-sectional configuration at a first depth; and the lower region has parallel grooves having a squarer cross-sectional configuration than the grooves of the middle region and at a second depth deeper than the first depth.

60. A pitching wedge having a club face with a top edge and a bottom edge, comprising:

upper, lower and middle regions on the club face, the upper region being oriented nearer the top edge than the middle region and the lower region being oriented nearer the bottom edge than the middle region, and wherein:

the upper region has a toughened surface;

the middle region has parallel grooves having a square-v cross-sectional configuration at a first depth; and the lower region has parallel grooves having a squarer cross-sectional configuration than the grooves of the middle region and at a second depth deeper than the first depth.

61. A golf club head, comprising:

a club face having upper, lower and middle regions such that the upper and lower regions are not adjacent in a vertical direction, the upper and lower regions having grooves with the same cross-sectional configuration and the middle region having grooves with a different cross-sectional configuration.

62. A golf club head according to claim 61, wherein the upper and lower regions have V-shaped grooves.

63. A golf club head according to claim 61, wherein the upper and lower regions have square-V grooves.

64. A golf club head according to claim 61, wherein the upper and lower regions have dimples.

65. A golf club head according to claim 64, wherein the dimples are punch marks.

66. A golf club head according to claim 61, wherein the upper and lower regions have roughened surfaces.

* * * * *